US008201770B2

(12) United States Patent
Dermo

(10) Patent No.: US 8,201,770 B2
(45) Date of Patent: Jun. 19, 2012

(54) TOILET PAPER ROLL HOLDER CAPACITY EXTENDER

(76) Inventor: Mario S. Dermo, Warren, MI (US)

( * ) Notice: Subject to any disclaimer, the term of this patent is extended or adjusted under 35 U.S.C. 154(b) by 0 days.

(21) Appl. No.: 12/887,001

(22) Filed: Sep. 21, 2010

(65) Prior Publication Data

US 2012/0067998 A1 Mar. 22, 2012

(51) Int. Cl.
*B65H 75/18* (2006.01)

(52) U.S. Cl. ..... 242/598.2; 242/598

(58) Field of Classification Search ..... 242/598, 242/598.3, 598.4, 599, 599.1, 599.3, 599.4, 242/596.7, 598.2
See application file for complete search history.

(56) References Cited

U.S. PATENT DOCUMENTS 1,772,917 A * 8/1930 Sifferman ..... 242/598.1
3,834,636 A * 9/1974 Linick ..... 242/598.5
3,848,822 A * 11/1974 Boone ..... 242/590
4,103,838 A * 8/1978 Young ..... 242/592
5,464,170 A * 11/1995 Mitchell et al. ..... 242/598
5,704,565 A 1/1998 Cheng
5,718,404 A * 2/1998 Greer ..... 248/309.2
5,848,762 A 12/1998 Reinheimer et al.
5,868,342 A 2/1999 Moody et al.
6,328,255 B1 12/2001 Moody et al.
6,364,245 B1 4/2002 Paal et al.

* cited by examiner

*Primary Examiner* — Michael Mansen
*Assistant Examiner* — Juan Campos, Jr.
(74) *Attorney, Agent, or Firm* — Young Baslle Hanlon & MacFarlane PC

(57) ABSTRACT

Several embodiments of an apparatus for increasing the roll diameter capacity of a toilet paper roll holder are disclosed. One of the embodiments uses elongate extenders which are adhesively attached to the inside surfaces of a conventional roll holder. Another embodiment uses simple links which are attached by pins to the existing spindle receptacles in the roll holder. The links may be substantially permanently attached to the ends of a telescopic spindle.

2 Claims, 3 Drawing Sheets

FIG. 1
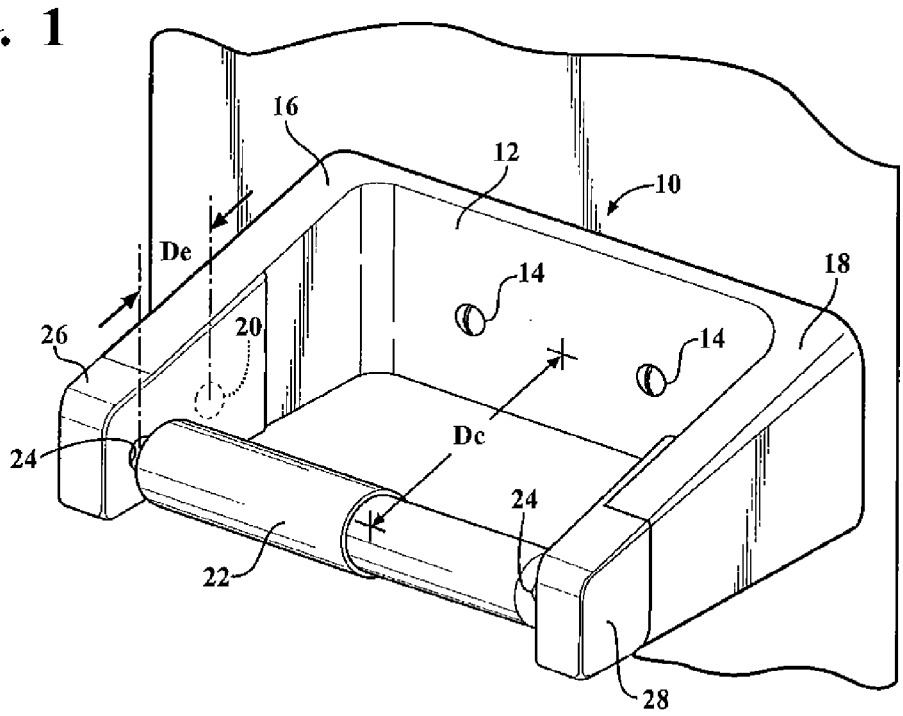
FIG. 2
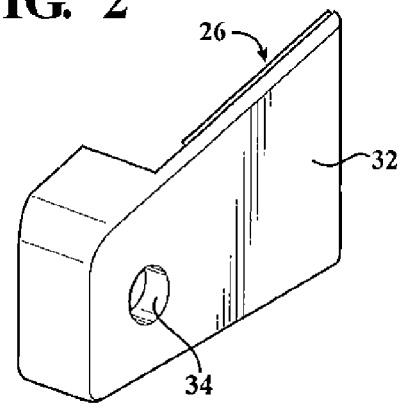
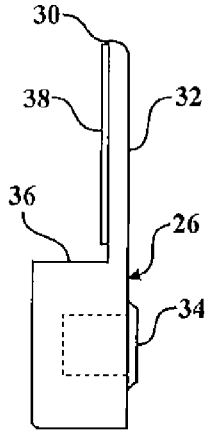
FIG. 3

TOILET PAPER ROLL HOLDER CAPACITY EXTENDER

FIELD OF THE INVENTION

This invention relates to devices for increasing the roll diameter capacity of a toilet paper roll holder.

BACKGROUND OF THE INVENTION

Toilet paper roll holders are available in a variety of configurations including a one-piece construction comprising a base adapted to be attached by screws or adhesive to a wall or partition. Integral with said base plate are two of outwardly extending, spaced-apart arms which are parallel to one another in use and may either be fixed or collapsible. A spindle (also called a "roller") is provided, resiliently adjustable in length for mounting between said arms, the opposite end pins of the spindle extending into receptacles near the outward distal ends of said arms.

Toilet paper roll holders are also available in various styles and comprising two totally separate posts which can be independently attached to a wall or partition. When mounted, a spindle is mounted between them to accommodate a roll of toilet paper.

In both of the roll holder types described above, the roll diameter capacity is limited by the distance between the spindle axis and either the base plate or the wall or partition. Toilet paper rolls are now available in a variety of sizes including "jumbo" size rolls of 5 or more inches in diameter, too large to be carried by some toilet paper roll holders; i.e., the outer surface of the roll hits the wall or base surface and will not rotate.

SUMMARY OF THE INVENTION

The present invention provides an apparatus for simply and inexpensively increasing the roll diameter capacity of any type of conventional toilet paper roll holder having opposed arms or posts adapted to receive a spindle therebetween. Several different embodiments of the invention are disclosed.

According to one embodiment of the invention, a pair of link-type bodies is provided. The links are used in pairs to increase the roll diameter capacity of any conventional roll holder. They may be separate from a spindle or attached to it.

In accordance with one embodiment, the link is an elongate body having generally flat opposed surfaces and distal ends. For an extender which is separate from the spindle, a hole which may either be a through hole or a blind hole is formed in the body near one end, and a pin is either integral with or attached to the body near the opposite distal end and extending orthogonally from the body. When used in pairs, the links are inserted by means of said pins into the receptacles in the arms of a toilet paper roll holder which normally receive the spindle pins. Thereafter, the spindle is mounted between the blind or through holes in the opposite distal ends of the extenders thereby to increase the roll diameter capacity of the toilet paper roll holder.

The extenders may be made of many different materials but are preferably injection molded of a suitable plastic, such as PVC, polyethylene or polyurethane. The pins may be molded integral with the bodies or separately attachable thereto. The pin diameters may be such as to produce a snug fit or a loose fit; in the latter case, the extenders may hang downwardly somewhat in use.

As an alternative, a spindle may be formed integrally with or substantially permanently attached to the extender links. If the links are small enough, they will pass through the roll core without problem. If larger, one link can be hinged as hereinafter described.

In accordance with another embodiment of the invention, the extender bodies are elongate, generally flat members with opposite parallel surfaces, one of which has a step formed therein so that the step can be used to locate the extender body on the inside surface of a toilet paper roll holder arm. The stepped arm is also provided with an adhesive, generally in the form of a two-sided tape with a protective layer in place prior to installation. Receptacle holes, either blind holes or through holes, are formed in the opposite parallel plane surface to receive a spindle. Generally, the spindle is telescopic and spring-biased in one of the conventional fashions; i.e., the spindle pin itself may be telescopically depressible into the spindle body or the spindle itself can be made into two pieces which telescope over one another and are held apart by means of a spring.

BRIEF SUMMARY OF THE DRAWINGS

The description herein makes reference to the accompanying drawings wherein like reference numerals refer to like parts throughout the several views and wherein:

FIG. 1 is a perspective view of one embodiment of my invention as applied to a one-piece roll holder;

FIG. 2 is a perspective view of one of the extenders in the embodiment of FIG. 1;

FIG. 3 is a side view of the extender of FIG. 2;

DETAILED DESCRIPTION OF THE ILLUSTRATIVE EMBODIMENTS

Figure 4:
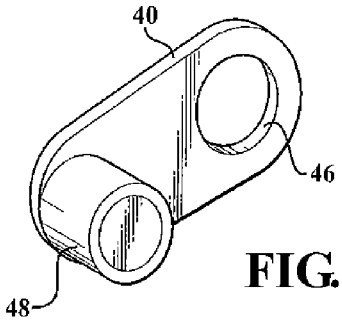
FIG. 4 is a perspective view of another extender.

Referring to FIGS. 1-3, there is shown a toilet paper roll holder 10 of the type comprising a base 12 with integral forwardly extending arms 16, 18. The base plate 12 is secured to a wall, partition or the like by means of screws 14. Alternatives such as adhesive attachments or slide-in brackets can also be used, The arms 16, 18 are spaced approximately 5 inches apart, are parallel and extend generally at right angles to the base 12.

Receptacles 20 are formed proximate the distal ends of the arms 16, 18 to receive the pins 24 of a spindle 22 therebetween. A toilet paper roll can be mounted on the spindle 22 in conventional fashion. Spindle 22 is also called a "roller".

In accordance with the invention, capacity extenders 26, 28 are secured to the arms 16, 18 in such a way as to extend the spindle axis away from the base 12 by a distance $D_e$ such that the increased roll diameter capacity is represented by the quantity $D_c$.

As better shown in FIGS. 2 and 3, each extender comprises a molded plastic body having opposite surfaces 30, 32 and a blind hole receptacle 34 formed in the surface 32 near one of the opposite distal ends of each body. The other surface 30 has a step 36 formed therein to help locate the body 26 on the end of the arm 16 as shown in FIG. 1 and to provide a smooth integrated appearance. A strip 38 of two-sided adhesive is secured to the surface 30 for attaching the extender 26 or 28 to the flat inside surface of the respective arms 16, 18. This attachment covers the normal spindle receptacles 20 and provides new locations 34 for receiving the spindle pins 24.

In use, the purchaser of the extenders 26, 28 removes a protective layer from the adhesive strip 38 and locates the extender, either 26 or 28 on the end of the appropriate arms 16, 18 with the adhesive against the flat inside surface of the original arm and the step 36 against the end of the arm. Thereafter, the spindle 22 is newly located in the receptacles 34, a distance $D_e$ away from the old axis of rotation. This distance may be typically on the order of one inch.

Figure 5:
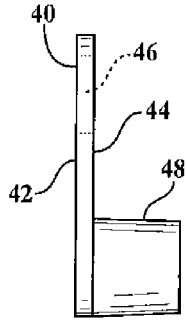
FIG. 5 is an end view of the extender of FIG. 4.

Referring now to FIGS. 4 and 5, there is shown a second embodiment of the invention wherein each extender body 40 is an elongate link of suitable plastic such as polyethylene having opposite plane surfaces 42, 44. A through hole 46 is formed through one distal end and a pin 48 is secured to the surface 44 near the opposite distal end and protects outwardly therefrom at right angles. The outside surface of the pin 48 may be ribbed with a compliant plastic material as shown.

In use, the extenders 40 are installed in pairs. The user removes the spindle 22 from the existing holder and inserts the pins 48 in the previously occupied spindle receptacles. As indicated above, the diameters of the pins 48 may be such as to produce either a snug or loose fit; in the latter case, the extenders 40 will hang down slightly in use. Preferably the ribs are such as to provide some friction between the extenders 40 and the arms 16, 18 of the conventional roll holder so that the extenders 40 stand essentially straight out from the wall or partition in which the roll holder 10 is mounted. In addition, the ribs help hold the extruders in place. Thereafter, the spindle is mounted between the extenders 40 by way of the holes 46 in conventional fashion.

Figure 6:
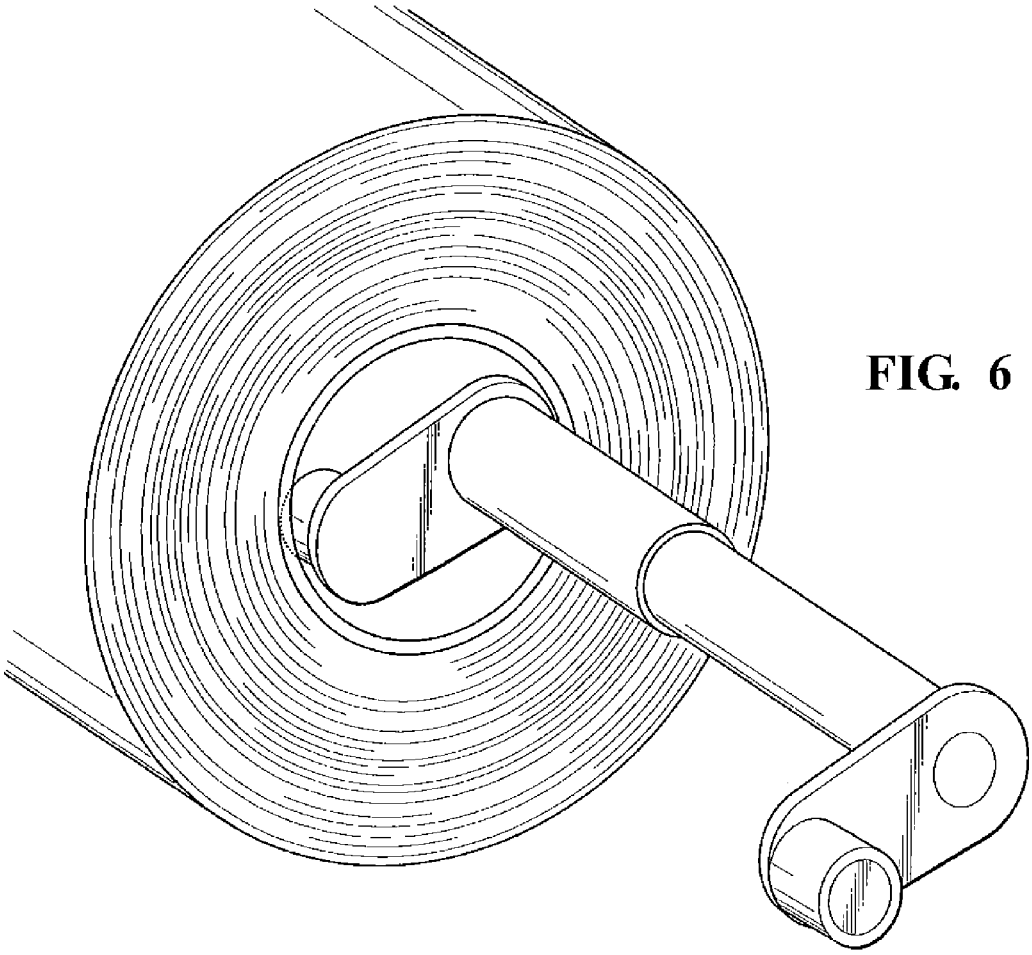
FIG. 6 is a perspective view of another embodiment wherein the extenders are integrated with a spindle.

FIG. 6 shows another embodiment in which a spindle 22' is permanently attached to links 50, having outwardly extending pins 52 identical to pins 48. Again, the pins may be with or without surface ribs. The spindle 22' is telescopic and spring-biased to the full-width condition. If the extender links are about 1¾" in overall length, they will pass through the cardboard roll core of a conventional toilet paper roll R when a fresh roll is to be mounted.

Figure 7:
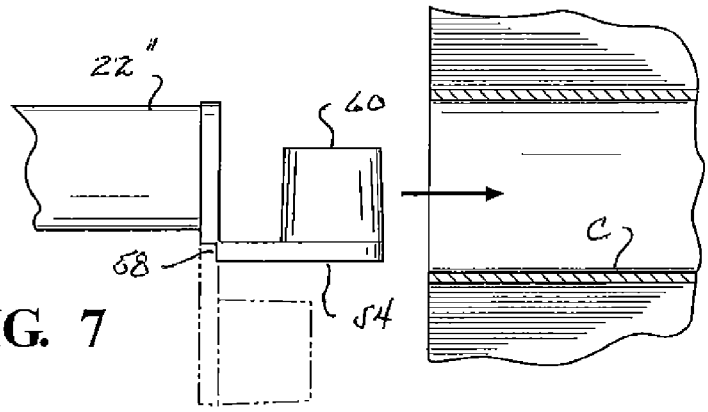
FIG. 7 is an end view of another integral extender/spindle showing a hinge in the extender.
Figure 8:
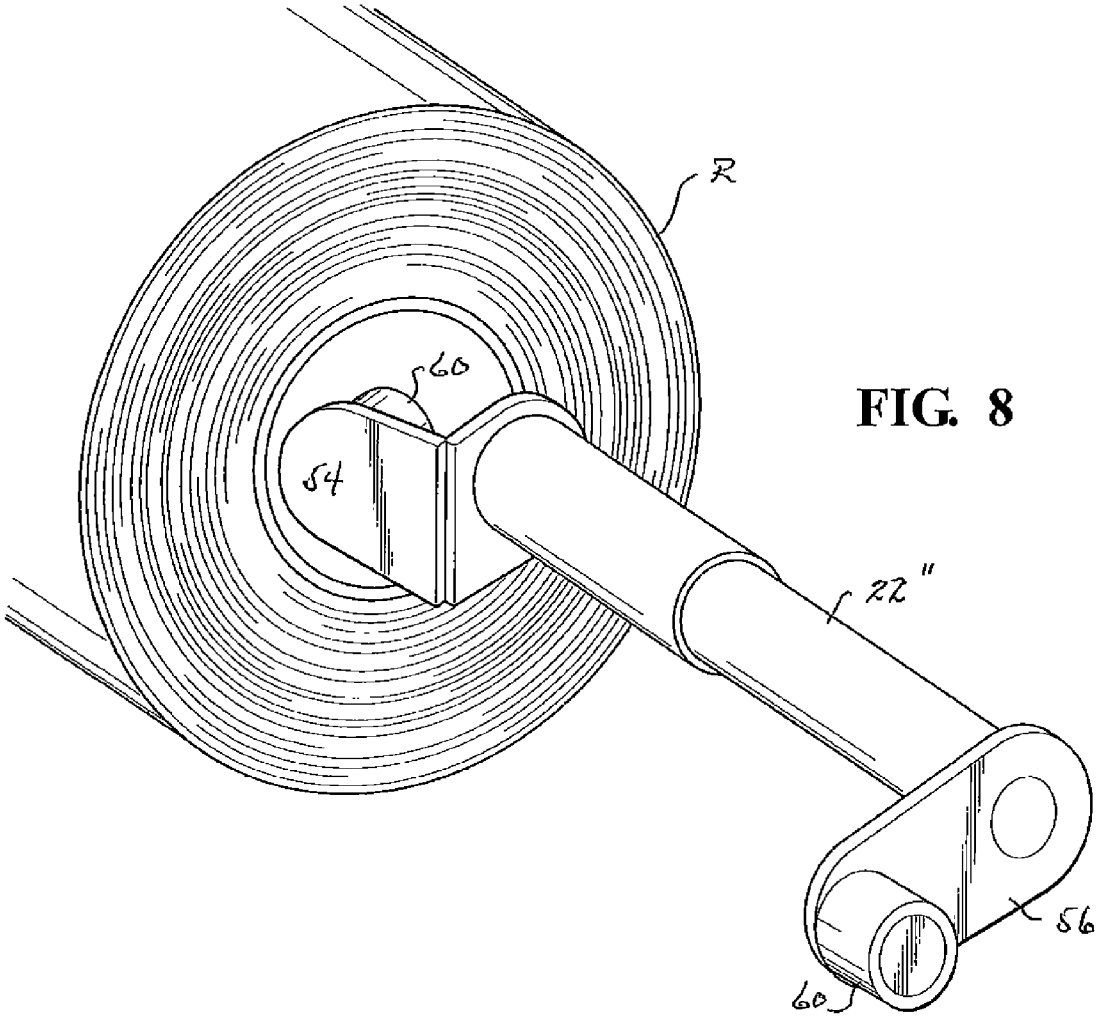
FIG. 8 shows how the extender of FIG. 7 goes into a toilet paper roll.

FIGS. 7 and 8 show a variation of the FIG. 6 embodiment including a way to accommodate even larger extender links 54, 56 permanently attached to a spindle 22", identical to spindle 22'. Here, the link 54 has a living hinge 58 between the spindle center and the mounting pin 60. When folded, the link 54 easily passes through a roll core C. The opposite end link 56 has no hinge.

Other applications of the present invention will become apparent to those skilled in the art when the following description of the best mode contemplated for practicing the invention is read in conjunction with the accompanying drawings.

What is claimed is:

1. A toilet paper roll holder capacity extender comprising:

a telescopic roll spindle having a roller axis and opposite ends; and a pair of thin, plastic extender links of oblong, smoothly rounded shape, each such link being permanently, non-rotatably attached to a respective end of said spindle and extending at right angles thereto, each link having an outwardly-extending cylindrical pin thereon non-co-axial with the spindle roller axis.

2. An extender as defined in claim 1 wherein one of side links is hinged.

* * * * *